US011851930B2

(12) United States Patent
Lee

(10) Patent No.: US 11,851,930 B2
(45) Date of Patent: Dec. 26, 2023

(54) HINGE SYSTEM AND METHOD FOR A SEGMENTED DOOR

(71) Applicant: Overhead Door Corporation, Lewisville, TX (US)

(72) Inventor: Bradley J. Lee, Arlington, TX (US)

(73) Assignee: Overhead Door Corporation, Lewisville, TX (US)

( * ) Notice: Subject to any disclaimer, the term of this patent is extended or adjusted under 35 U.S.C. 154(b) by 544 days.

(21) Appl. No.: 16/912,086

(22) Filed: Jun. 25, 2020

(65) Prior Publication Data

US 2021/0404242 A1 Dec. 30, 2021

(51) Int. Cl.

| | |
|---|---|
| ***E05D 15/24*** | (2006.01) |
| ***E06B 3/48*** | (2006.01) |
| ***E05D 15/16*** | (2006.01) |

(52) U.S. Cl.

CPC ..... *E05D 15/242* (2013.01); *E05D 15/165* (2013.01); *E06B 3/486* (2013.01); *E05Y 2900/106* (2013.01); *E05Y 2900/132* (2013.01)

(58) Field of Classification Search

CPC ..... E05D 15/242; E05D 15/165; E05Y 2900/132; E05Y 2900/106; E06B 3/486

See application file for complete search history.

(56) References Cited

U.S. PATENT DOCUMENTS

| | | | | |
|---|---|---|---|---|
| 3,092,870 | A | 6/1963 | Baer | |
| 3,402,422 | A | 9/1968 | Baer | |
| 4,976,008 | A | 12/1990 | Baer | |
| 5,337,451 | A * | 8/1994 | Goossens | E05D 5/12 16/354 |
| 5,636,893 | A * | 6/1997 | Wheatley | B60J 7/141 296/100.09 |
| 5,778,491 | A * | 7/1998 | Baer | E05D 3/122 16/234 |
| 5,941,027 | A * | 8/1999 | Hallsten | E06B 3/485 52/246 |
| 9,428,946 | B2 * | 8/2016 | Martinez Garcia | E05F 1/12 |
| 10,851,569 | B2 * | 12/2020 | Narvaez | E06B 3/509 |
| 11,396,770 | B2 * | 7/2022 | Romero | E05D 15/58 |
| 2015/0330127 | A1 | 11/2015 | Lee | |
| 2018/0002971 | A1 * | 1/2018 | Grace | E06B 3/483 |
| 2019/0264492 | A1 * | 8/2019 | Mitchell | E05D 15/26 |

* cited by examiner

*Primary Examiner* — Daniel P Cahn

*Assistant Examiner* — John W Hanes, Jr.

(74) *Attorney, Agent, or Firm* — HAYNES AND BOONE, LLP

(57) ABSTRACT

A hinge for movably attaching parts together incudes a first gear, a second gear, a cover configured to attach the first gear to the second gear, first and second sliding surfaces on the cover wherein the first gear slides on the first sliding surface and the second gear slides on the second sliding surface when the hinge is operated, and an area on the first gear with no teeth configured to slide past the second gear to allow the first gear to enter the cover. Assembling a hinge includes moving a surface without gear teeth on a first gear past a toothed surface on a second gear, moving the first and second gears into a cover, meshing a tooth on the first gear with a tooth on the second gear, and holding the first and second gears together with the cover.

18 Claims, 14 Drawing Sheets

HINGE SYSTEM AND METHOD FOR A SEGMENTED DOOR

TECHNICAL FIELD

This patent disclosure relates generally to a hinge system and, more particularly, to a hinge system for an upward acting segmented door, such as, a garage door.

BACKGROUND

Segmented sectional doors, such as garage doors, have several hinges that allow the sections to pivot with respect to each other. Many types of hinges may be used. Traditional leaf-hinges are bulky and made from sheet metal stampings. Some have crude plated finishes.

There is a desire to change garage door designs to become more aesthetically pleasing. In an effort to have a sleeker door design, current traditional leaf-hinges may be replaced with an alternative hinge system. Examples of hinges are described in U.S. Pat. Nos. 3,092,870; 3,402,422; (both titled "Hinge" and 4,976,008 titled "Multi-Piece Thrust Bearing Assembly for a Hinge Structure" all of which are incorporated herein by reference in their entirety.

Traditional hinges typically require several screws with self-drilling and serrated self-locking features. These hinges may be labor intensive to install. It would be desirable to have more aesthetically looking hinges that are require fewer fasteners, fewer hardware components, and are less labor intensive to install.

SUMMARY

The foregoing needs are met to a great extent by embodiments in accordance with the present disclosure, wherein, in some embodiments allows in one aspect, a hinge for movably attaching to parts together. The hinge incudes: a first gear; a second gear; a cover configured to attach the first gear to the second gear; a first sliding surface on the cover; a second sliding surface on the cover wherein the first gear slides on the first sliding surface and the second gear slides on the second sliding surface when the hinge is operated; and an area on the first gear with no teeth and the area with no teeth is configured to slide past the second gear to allow the first gear to enter the cover.

In another aspect, the disclosure describes a hinge for movably attaching to parts together. The hinge includes: a first gear; a second gear; a cover configured to attach the first gear to the second gear, the cover having a first protrusion and a second protrusion facing the first protrusion and first protrusion fits into a recess in the first gear and the second protrusion fitting into a recess in the second gear; a first sliding surface on the first protrusion; a second sliding surface on the second protrusion wherein the first gear slides on the first sliding surface and the second gear slides on the second sliding surface when the hinge is operated, wherein the first gear has an area with no teeth and the area with no teeth is configured to allow the first gear to rotation on the first protrusion slide past the second gear to allow the first gear to enter the cover.

In yet another aspect, the disclosure describes a method of forming a hinge comprising: extruding a first gear; extruding a second gear; forming a cover configured to attach the first gear to the second gear; extruding a first sliding surface on the cover; extruding a second sliding surface on the cover wherein the first gear slides on the first sliding surface and the second gear slides on the second sliding surface when the hinge is operated; and extruding at least a portion of a segment for a segmented door along with the extruding of at least one of either the first and second gear.

The disclosure also provides, in another aspect a method of assembling a hinge. The method includes: moving a surface without gear teeth on a first gear past a toothed surface on a second gear; moving the first and second gears into a cover; meshing a tooth on the first gear with a tooth on the second gear; and holding the first and second gears together with the cover.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Additional features, advantages, and aspects of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate aspects of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION

Figure 1:
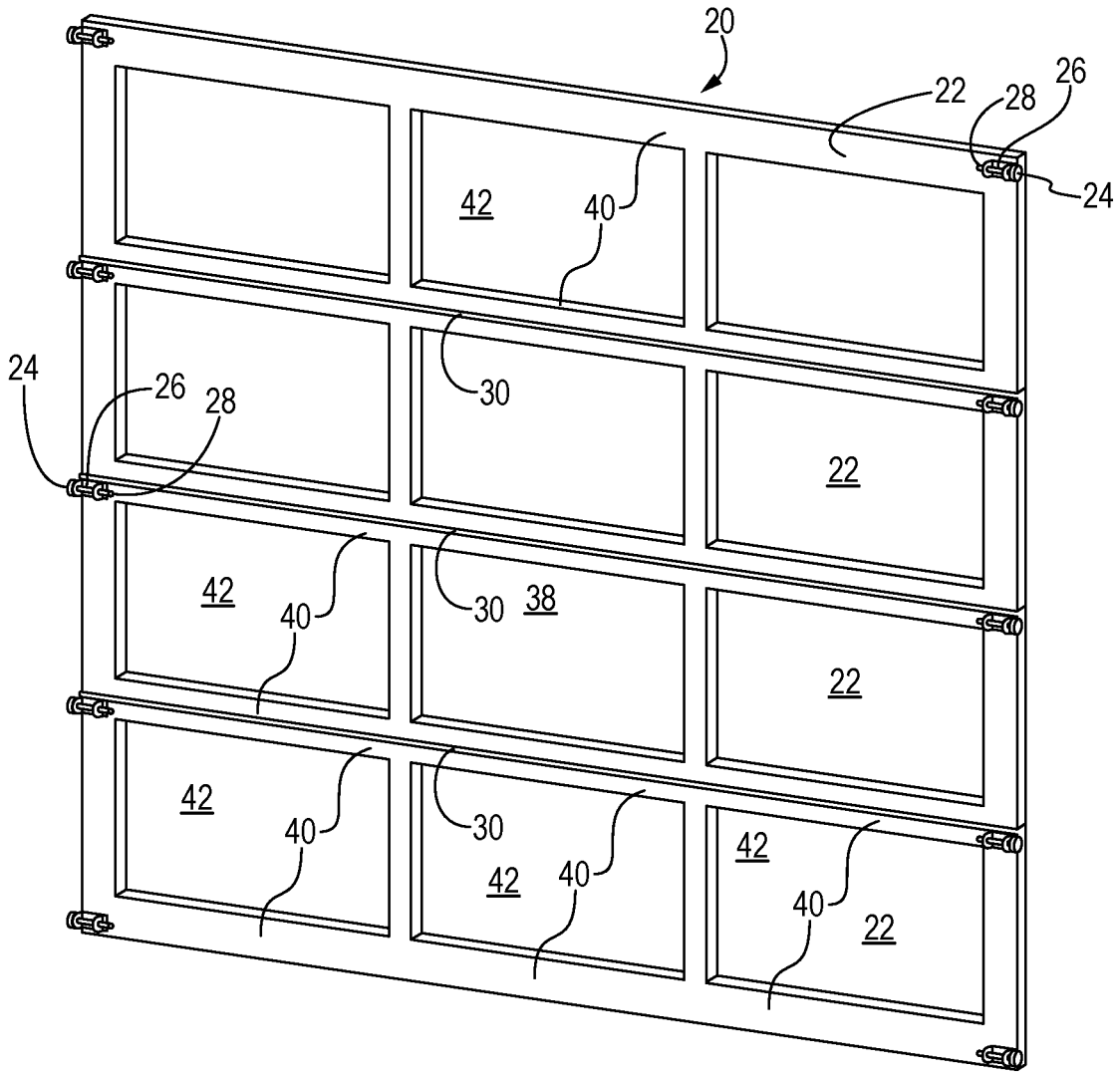
FIG. 1 is a perspective rear view of an upward acting segmented door.

The aspects of the disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the disclosure. The examples used herein are intended merely to facilitate an understanding of ways in which the disclosure may be practiced and to further enable those of skill in the art to practice the aspects of the disclosure. Accordingly, the examples and aspects herein should not be construed as limiting the scope of the disclosure, which is defined solely by the appended claims and applicable law. Moreover, it is noted that like reference numerals represent similar parts throughout the several views of the drawings.

Figure 2:
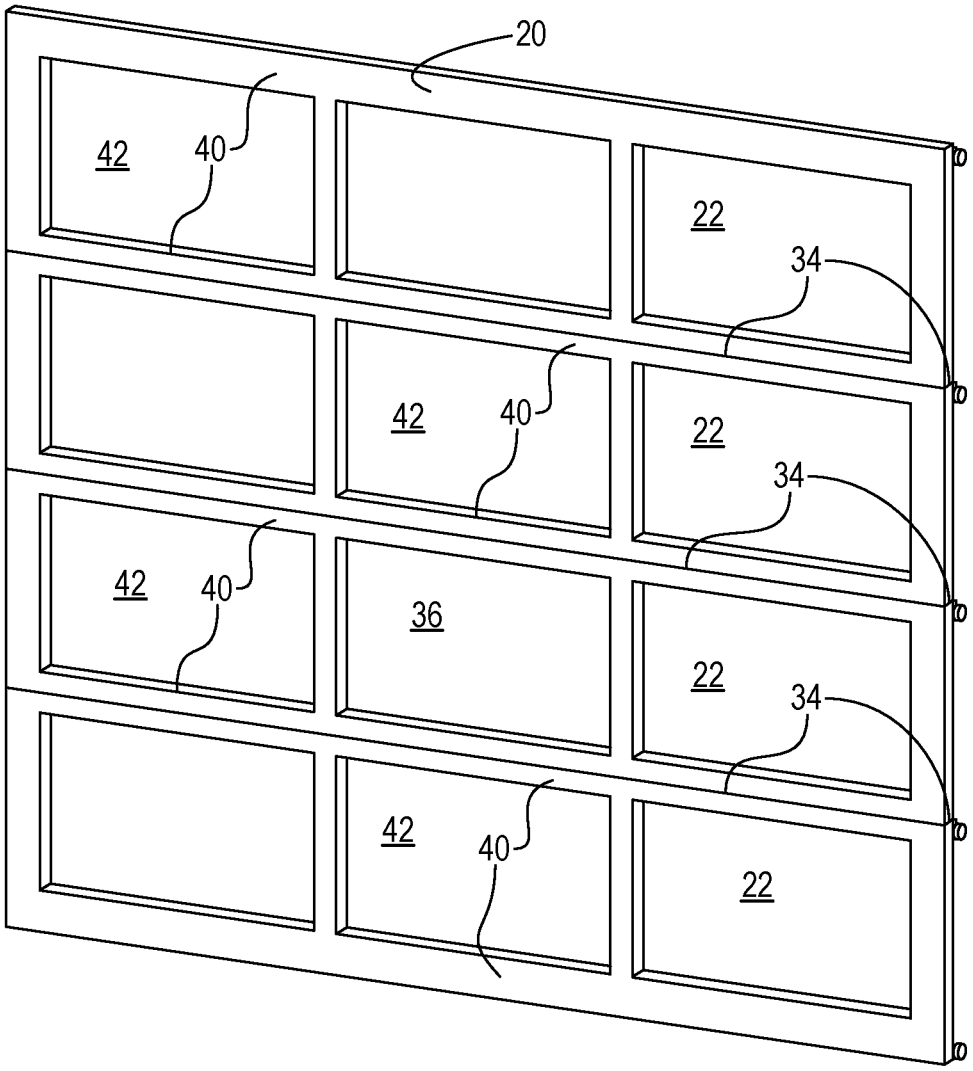
FIG. 2 is a perspective front view of an upward acting segmented door.

FIGS. 1 and 2 show an interior and exterior perspective view of an upward acting segmented door 20. Such a door 20 may be used, for example as a residential garage door 20. Other uses for such a segmented door 20 may include commercial uses such as warehouses, fire houses, loading docks and the like. These examples are exemplary and not limiting.

The segmented door 20 is made of several panels 22 which may also be referred to as segments 22. The door 20 has wheels 24 located on the segments 22. The wheels 24 are supported and attached to the segments 22 by wheel brackets 26 via a wheel axle 28. The wheels 24 allow the door 20 to move along a track (not shown).

FIG. 1 shows a back side 38 of the door 20 which may sometime be referred to as the interior side 38. FIG. 2 shows the front side 36 of the door 20 which may also be referred to as the exterior side 36 of the door 22.

As shown in FIG. 1, a retainer 30 which may also be referred to as a hinge cover 30 covers a hinge 32. The hinge 32 connected various segments 22 and allow the segments 22 to move in a pivoting-like manner with respect to each other. The segments 22 form a joint 34 where the segments 22 come together.

Figure 3:
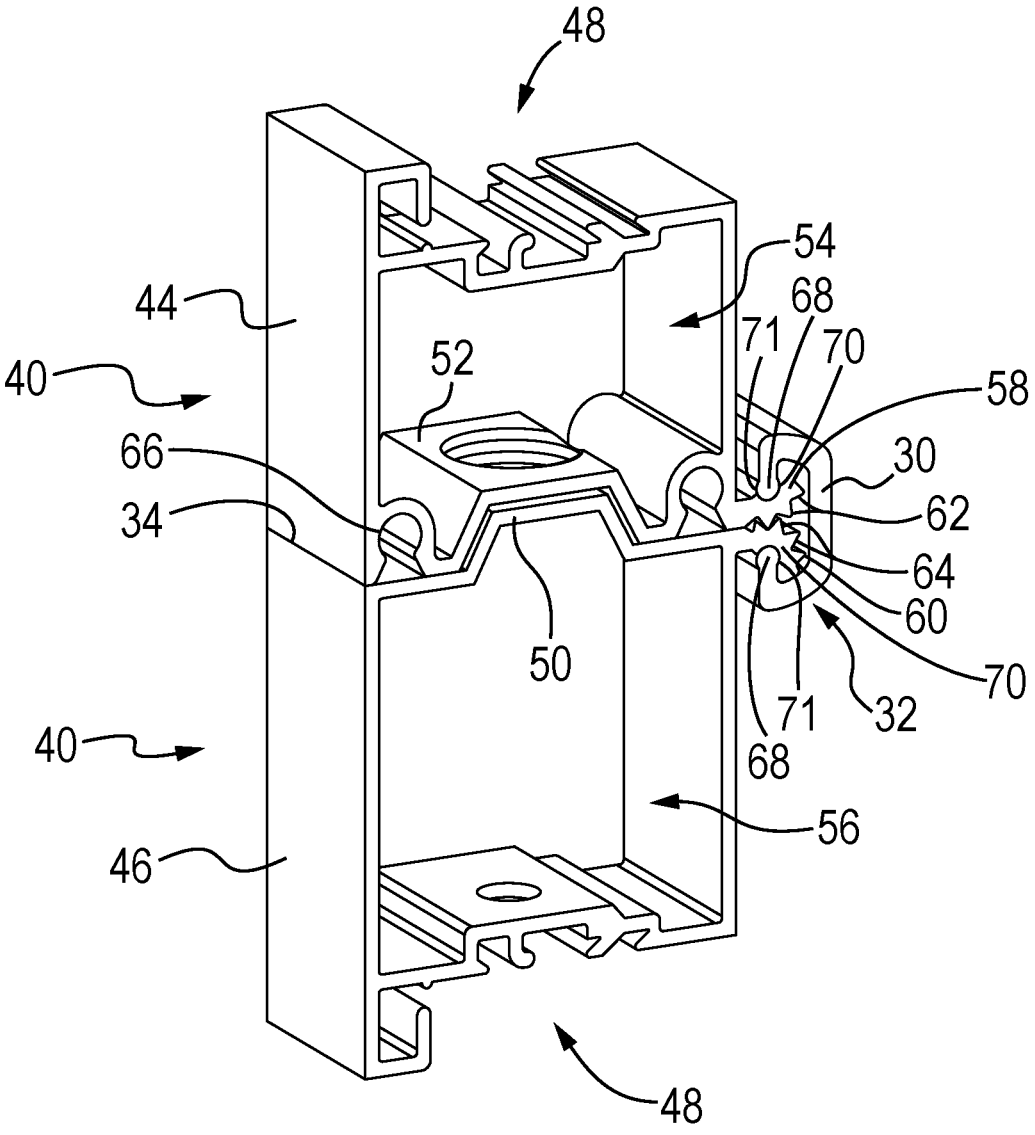
FIG. 3 is a perspective view of panel frames and a hinge in a closed position.
Figure 4:
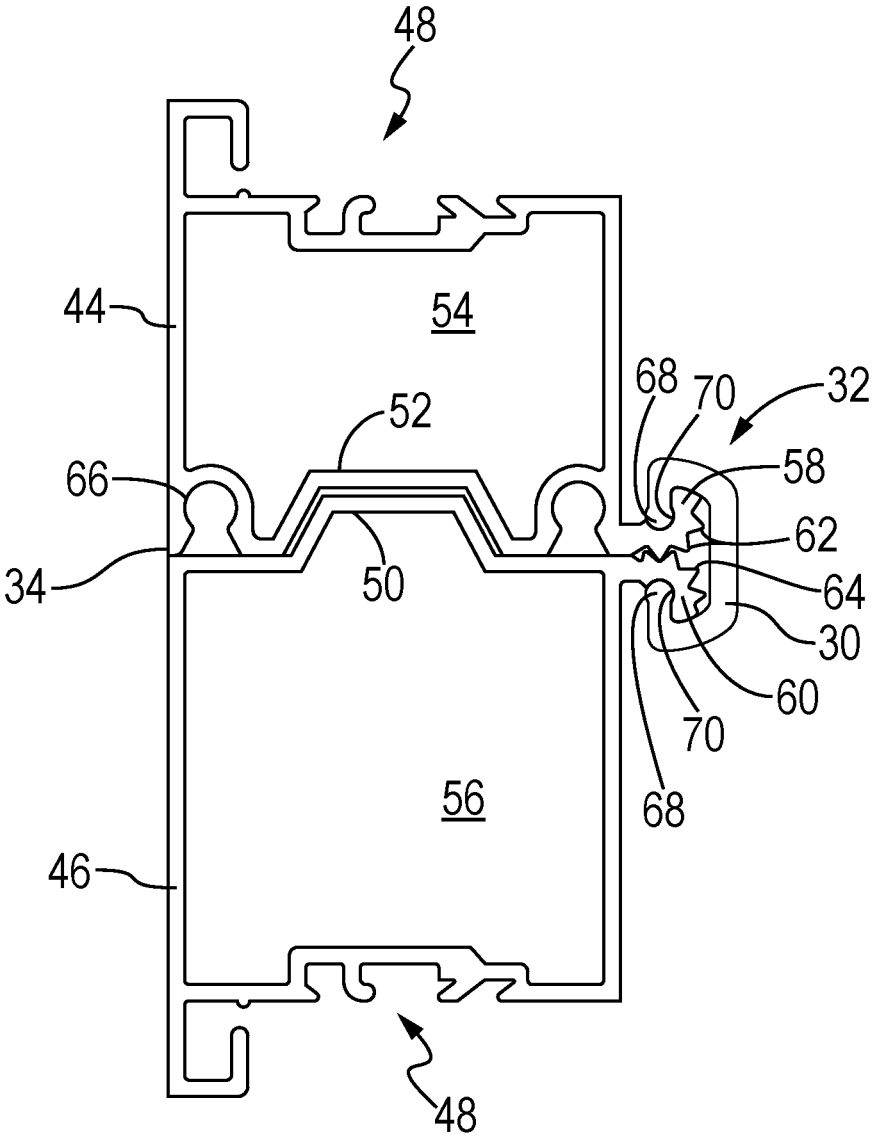
FIG. 4 is a side view of panel frame and hinge in a closed position.
Figure 5:
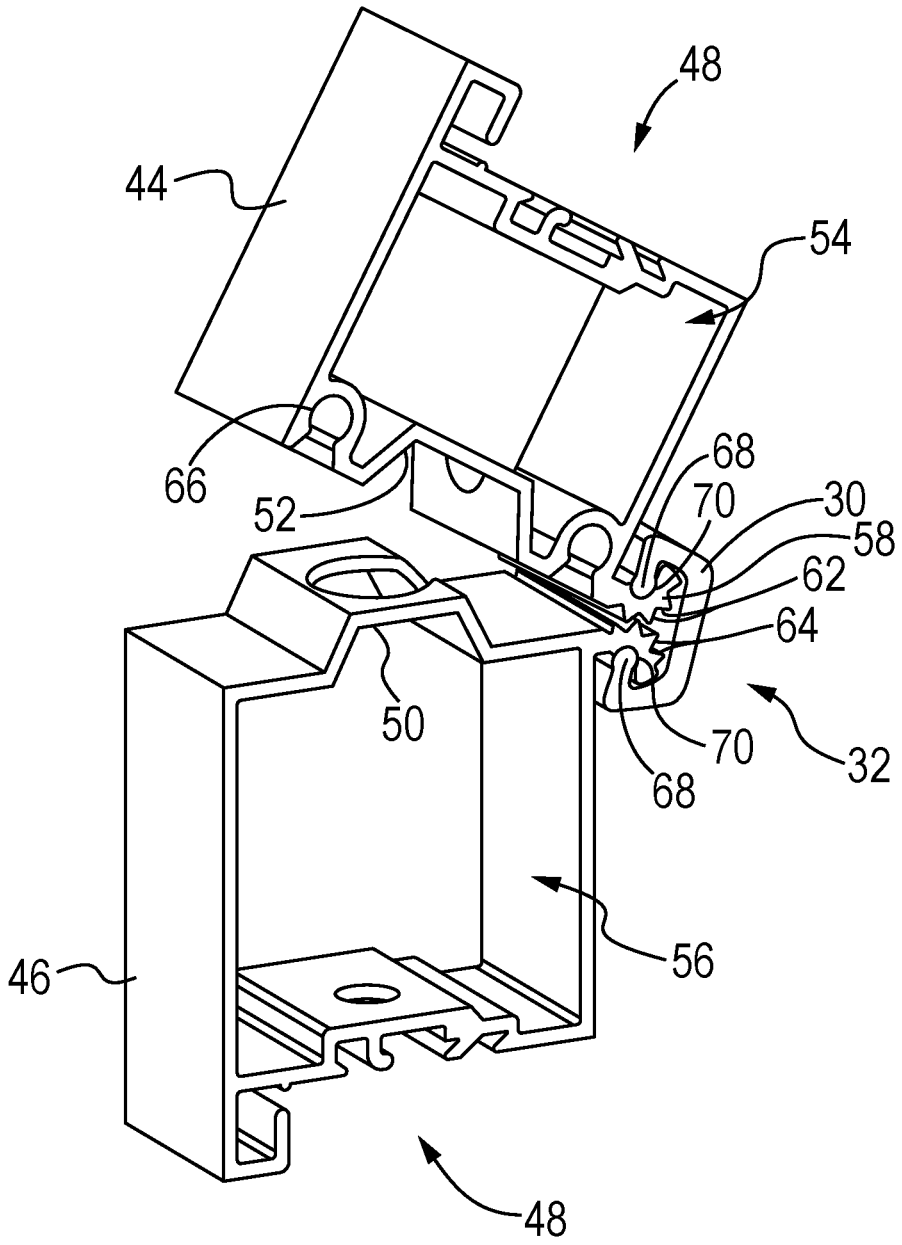
FIG. 5 is a perspective view of panel frames and a hinge in an open position.
Figure 6:
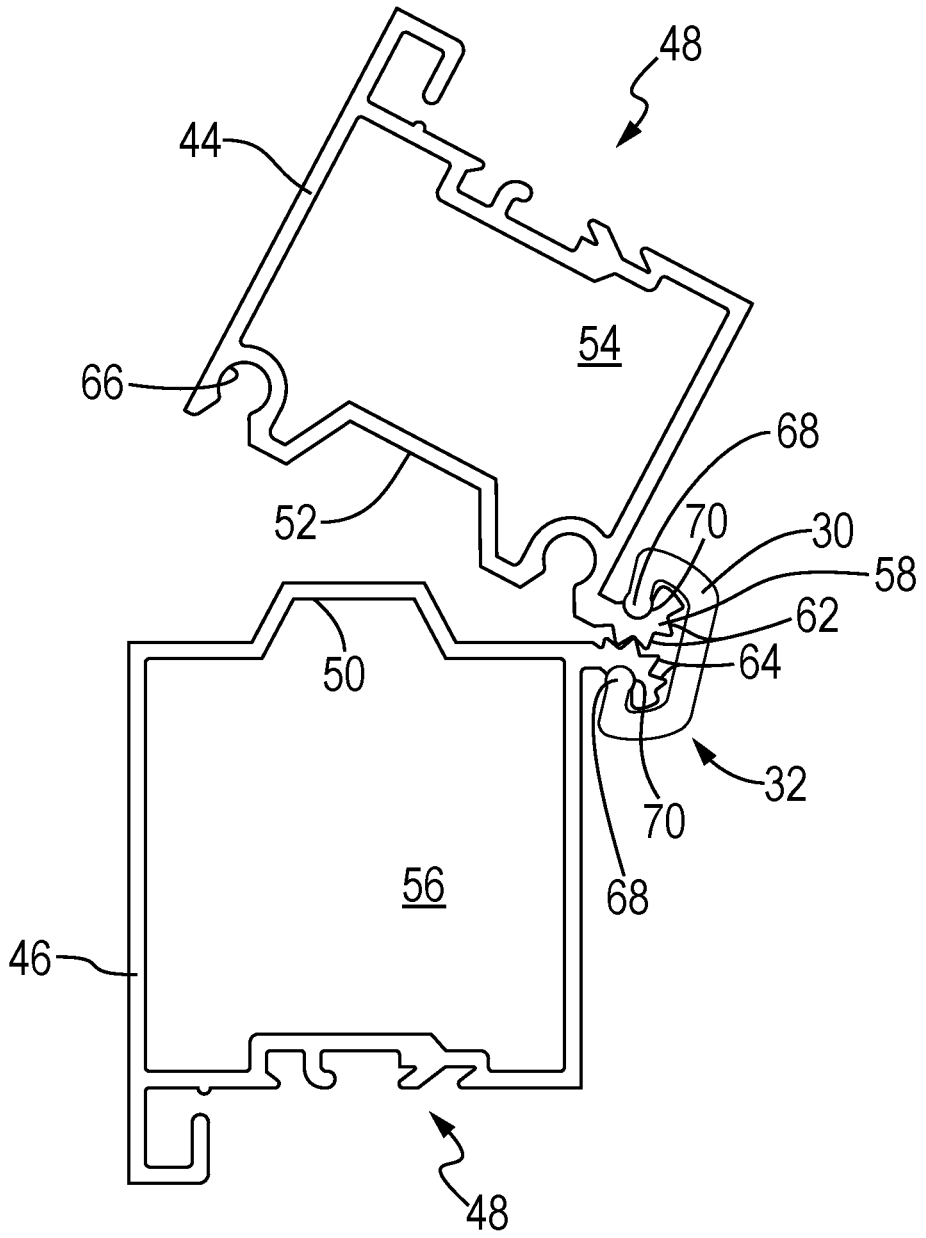
FIG. 6 is a side view of panel frames and a hinge in an open position.

The panels 22 or segments 22 may be a single unitary piece, comprised of several wood or other sections, or as shown, made of a frame 40 and an insert 42. The insert 42 may be a window, a panel or other type of insert 42. As shown, for example in FIG. 3, the frame 40 may include a first frame portion 44 which may be the lower part of the frame 40 on a panel 22 and a second frame section 46 which is the upper part of the frame 40. As shown in FIG. 3, a lower frame portion 44 is on a panel 22 located above the upper frame section 46 on a panel 22 located below.

As shown in FIGS. 3-6, the first and second frame portions 44, 46 include attaching structure 48 for attaching the first frame portion 44 to an insert 42 (see FIG. 1 or 2). The first 44 and second 46 frame sections are configured to fit together at the joint 34. The joint 34 may be a water shedding joint such as tongue & groove, shiplap, or the like. The first and second frame portions 44 and 46 may have a projecting portion 50 that fits into a complimentary concave portion 52. The frame portions 44 and 46 may define hollow portions 54 and 56.

The first and second panel frames 44 and 46 are equipped with a first gear 58 and a second gear 60 respectively. The first gear 58 has first gear teeth 62 and the second gear 60 has second gear teeth 64. When the hinge 32 is actuated, the gear teeth 62 and 64 mesh together to cause the first panel frame 44 (and therefore one panel 22) and second panel frame 46 (and therefore a second panel) to move in a pivot-like movement with respect to each other. Optionally, the first and second panel frames 44 and 46 may also include one or more cavities 66 for locating a seal.

The first and second gears 58 and 60 are held together by the cover 30 also referred to as a retainer 30. The cover 30 has two rounded projections 68 that fit into corresponding receiving structure 70. When the hinge 32 is actuated the rounded projection 68 and corresponding receiving structure 70 slide on sliding surfaces 71 (noted in FIG. 3) on the rounded projection 68 and corresponding receiving structure 70 with respect to each other.

FIGS. 1, 2, 3, 4, 7A, 8, 9, 10, 13 and 14 show the hinge 32 and first 40 and second 44 panel frames in a closed position. FIGS. 5, 6, 11, and 12 show the hinge 32 and first 40 and second 44 panel frames in an open position where the gear teeth 62 and 64 are meshed and have rotated with respect to each other. In both cases, the cover 30 is retaining the first gear 58 with the second gear 60.

In some embodiments the panel frames 40 and particularly, the first and second frames 44 and 46, are extruded. They may be aluminum or any other suitable substance. The first and second frames 44 and 46 are extruded along with the first and second gears 58 and 60 so that the gears 58 and 60 are unitized and with and conformed with the panel frames 44 and 46. In some embodiments the panel frames 44 and 46 have substantially uniform cross-sections which is often a characteristic of extruded parts.

Figure 7A:
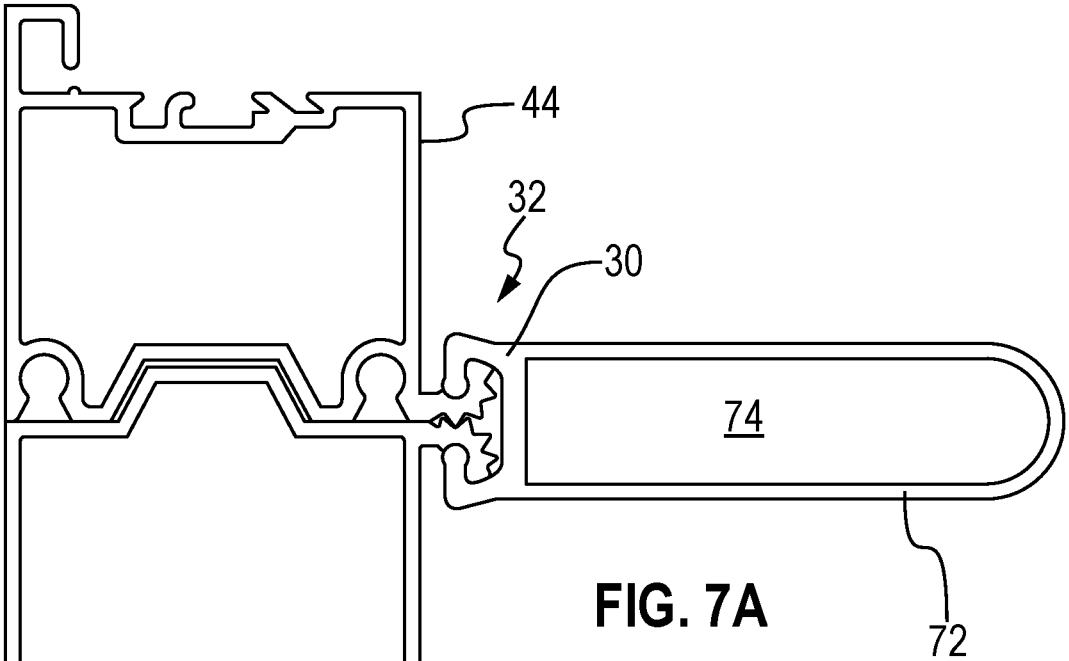
FIGS. 7A and 7B are side views of panel frames and a hinge with an alternate hinge cover.
Figure 7B:
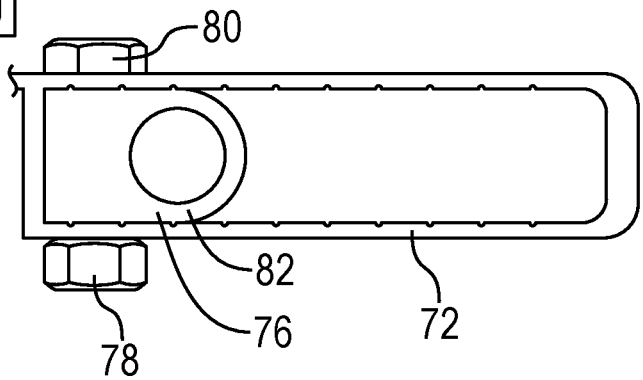
Figure 8:
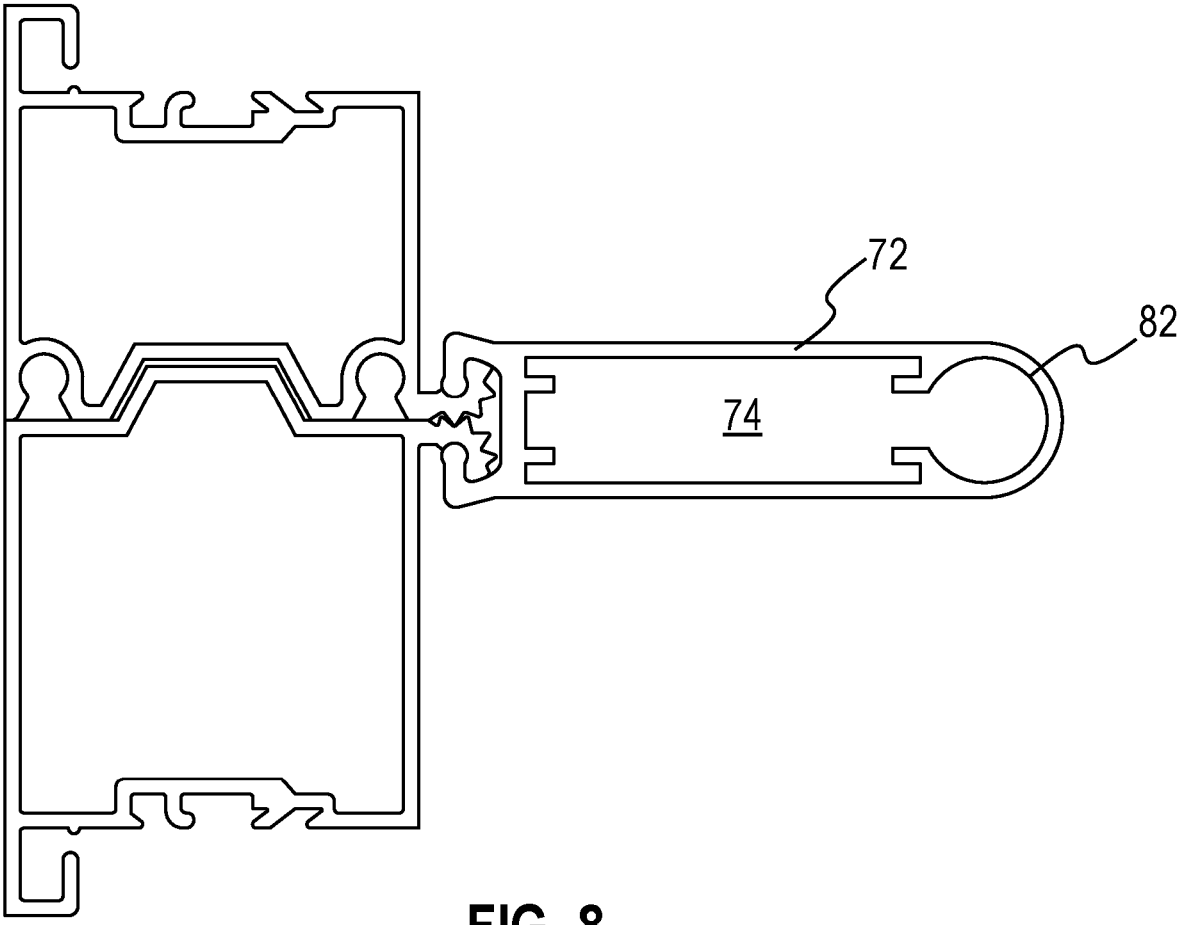
FIG. 8 is a side view of panel frames and a hinge with another alternate hinge cover.
Figure 9:
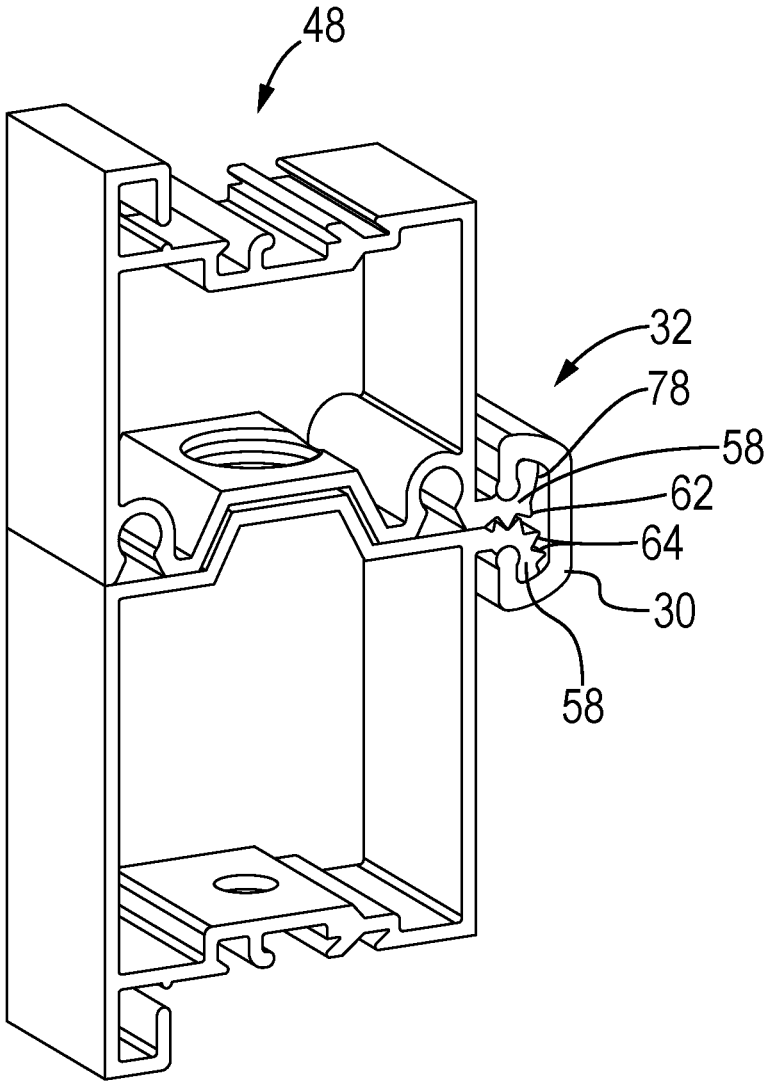
FIGS. 9-14 are similar to FIGS. 3-6, 7A, and 8 with a different hinge.
Figure 10:
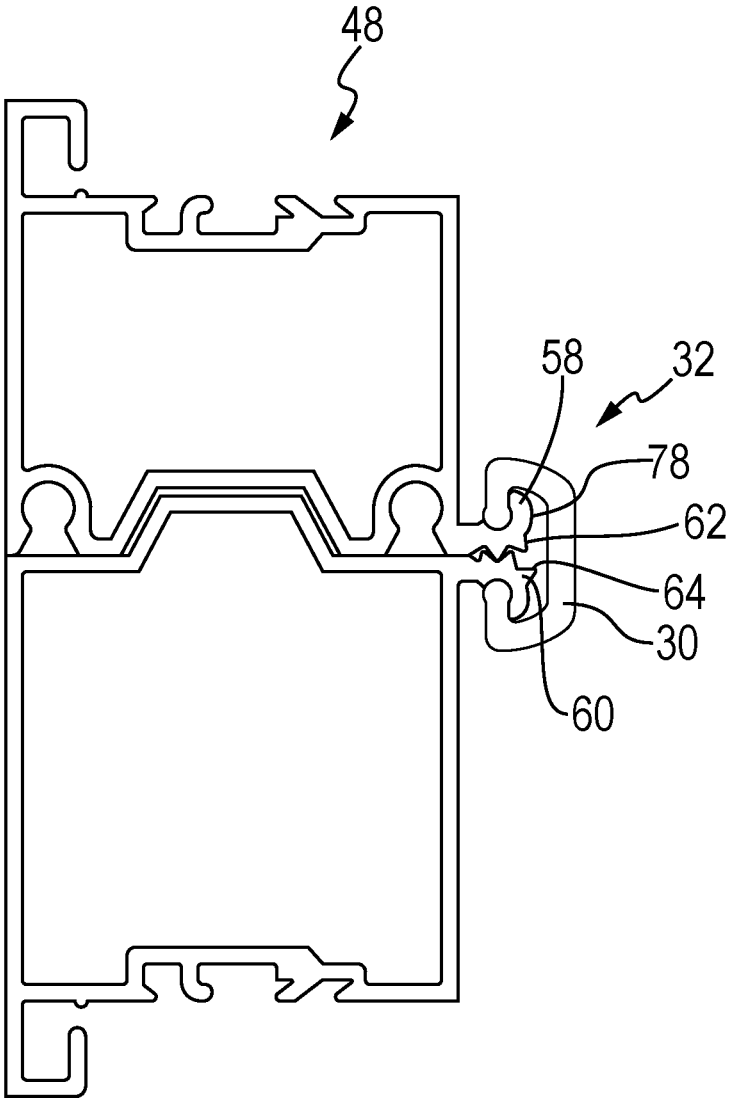
Figure 11:
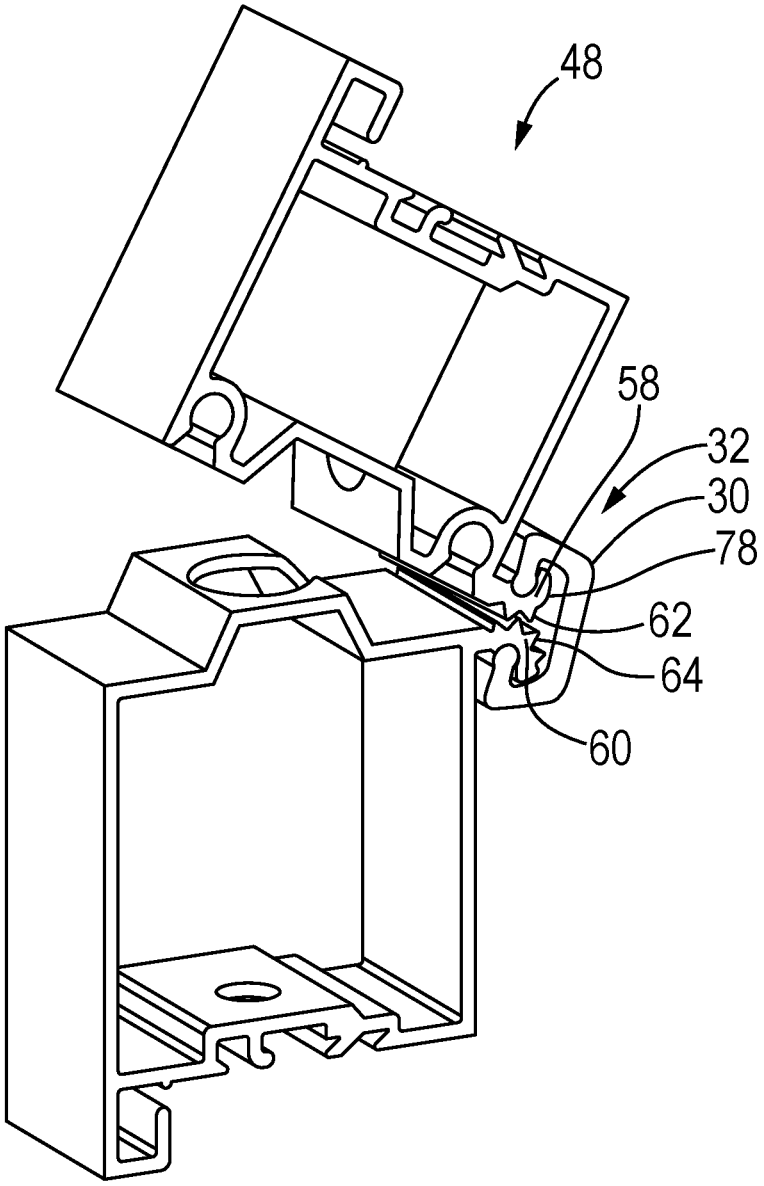
Figure 12:
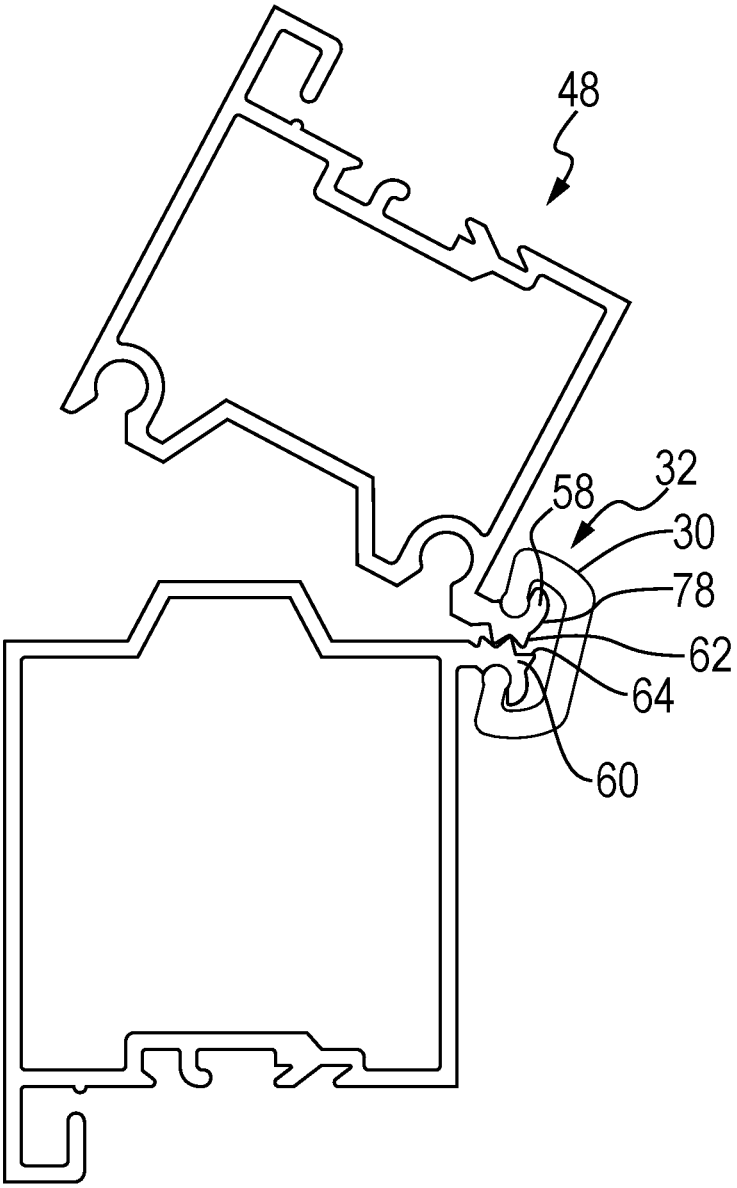
Figure 13:
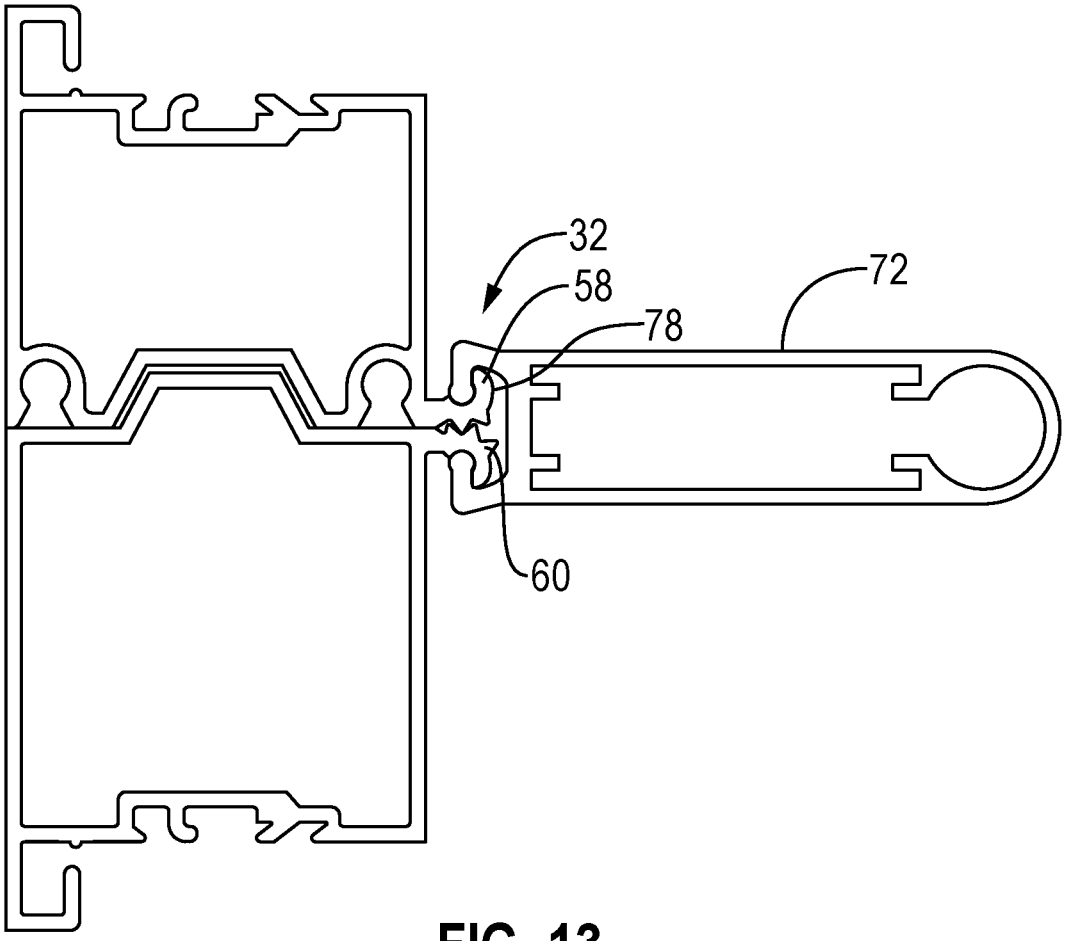
Figure 14:
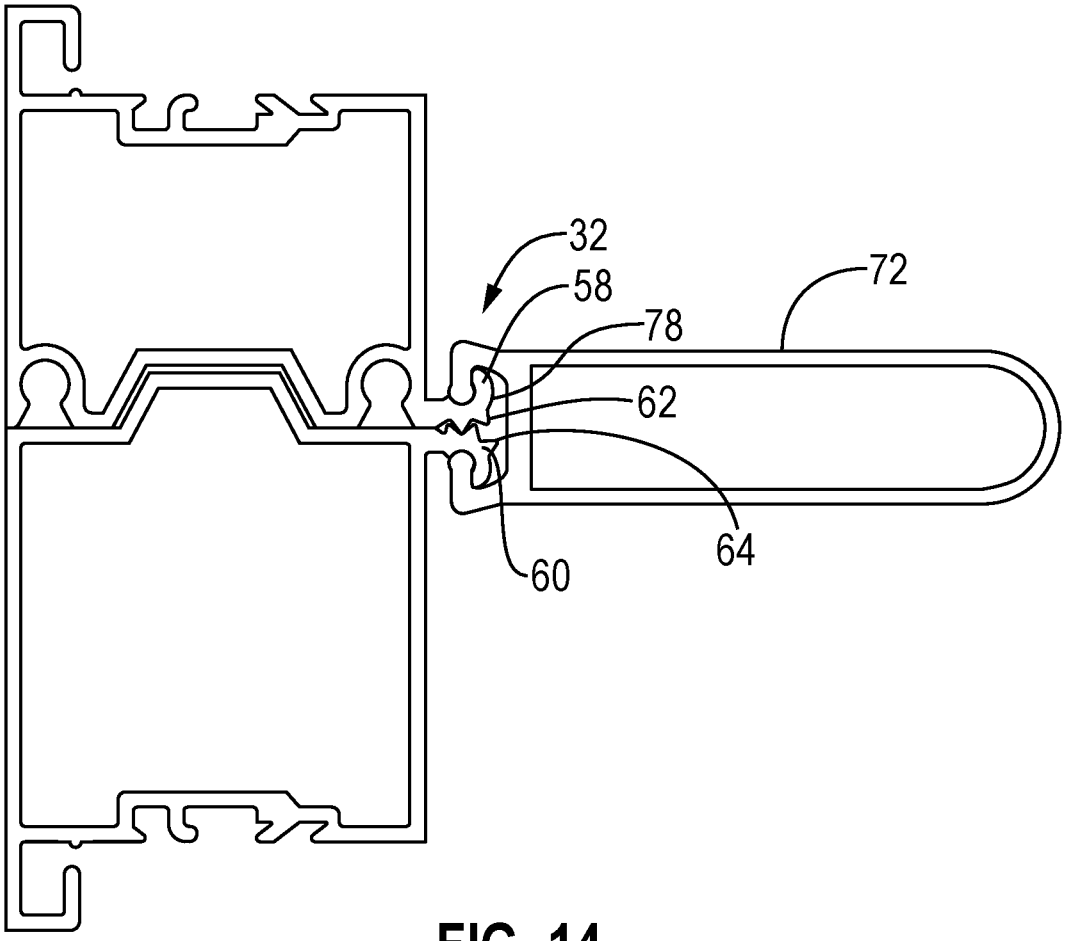

FIGS. 7A, 7B, and 8 illustrate an embodiment where the cover 30 is integrated with an elongated body 72. In some embodiments the elongated body 72 is hollow and defines a cavity 74. One purpose of the elongated body 72 on the cover 30 is be a stiffener and strengthen the hinge 32 and/or door 20 (See FIGS. 1 and 2).

FIGS. 7B and 8 show how the elongated body 72 may attach to an axle bracket 76. The axle bracket 76 may be modified from the axle bracket 26 discussed above to accommodate being attached to the elongated body 72. In FIG. 7B the axle bracket 76 is attached to the elongated body 72 by use of an axle bracket bolt 78 and an axle bracket nut 80. In both FIGS. 7B and 8, the round hole 82 is for the wheel axle 28 (see FIGS. 1 and 2) to reside in.

FIGS. 3, 4, 5, 6, 7A, and 8 show an embodiment where the hinge 32 has gears 58 and 60 of substantially mirror image geometry (other than perhaps placement of gear teeth 62 and 64). Such a hinge 32 is typically constructed by aligning the gears 58 and 60 sliding on the cover 30. While this method of assembly works well it can be cumbersome in embodiments with long covers 30. The cover 30 may be extruded the full length of the hinge 32 or be extruded or cut into several lengths to form the full length of the hinge 32. Optionally, the hinge 32 may be made of alternate components as described below to make the hinge 32 easier to assemble.

FIGS. 9-14 show a hinge 32 where the first 58 and second gear 60 differ from each other. To aid in assembly of the hinge 32, one or the other of the first 58 and second gears 60 has an area of no teeth 78. In some embodiments the gear with the area 78 of no teeth will have fewer teeth than the other gear.

Having an area 78 of no teeth is useful for assembling the hinge 32. The gear with no untoothed area 78 (in the FIGS. second gear 60) is moved into the cover 30. Then the gear with the area 78 having no teeth (in the FIGS. this is the first gear 58) is rotated so the area 78 of no teeth can slide over the teeth 64 of the second gear 60 and into the cover 30. The gear 58 with the area 78 of no teeth can then be rotated to allow the first teeth 62 on the first gear 58 mesh with the second gear teeth 64 on the second gear 60 as shown in FIGS. 9-14. Once assembled, the hinge 32 of FIGS. 9-14 operates similar to the hinge 32 of FIGS. 3-8.

While the disclosure has been described in terms of exemplary aspects, those skilled in the art will recognize that the disclosure can be practiced with modifications in the spirit and scope of the appended claims. These examples given above are merely illustrative and are not meant to be an exhaustive list of all possible designs, aspects, applications or modifications of the disclosure.

I claim:

1. A hinge for movably attaching a pair of parts together along a longitudinal reference line, comprising:

a first gear on a first part of the pair of parts, the first gear having a first center of rotation aligned along a second reference line perpendicular to the longitudinal reference line and having a) a toothed area with one or more first teeth and b) an area with no teeth, the area with no teeth being disposed on both sides of the second reference line when the hinge is in a closed position;

a second gear on a second part of the pair of parts, the second gear having a second center of rotation and having one or more second teeth, wherein the longitudinal reference line extends through the first and second centers of rotation;

a cover configured to attach the first gear to the second gear;

a first sliding surface on the cover defining the first center of rotation; and a second sliding surface on the cover defining the second center of rotation, wherein the first gear slides on the first sliding surface and the second gear slides on the second sliding surface when the hinge is operated, the area on the first gear with no teeth shaped and sized to slide past the second gear without engagement of the one or more first teeth and the one or more second teeth to introduce the first gear into the cover after a portion of the second gear is located in the cover.

2. The hinge of claim 1, further comprising a first protrusion opposite a second protrusion on the cover.

3. The hinge of claim 2, wherein the first sliding surface is on the first protrusion and the second sliding surface is on the second protrusion.

4. The hinge of claim 2, wherein the first protrusion is dimensioned to fit in a first recess in the first gear and the second protrusion is dimensioned to fit in a second recess in the second gear.

5. The hinge of claim 4, wherein the first and second protrusions keep the first and second gears engaged with each other.

6. The hinge of claim 1, wherein the hinge is actuated by meshing one or more gear teeth on the first gear with one or more gear teeth on the second gear.

7. The hinge of claim 1, wherein the first gear, second gear, and cover have cross-sections and a length and the cross-sections are substantially consistent throughout their respective lengths.

8. The hinge of claim 7, wherein the first gear, second gear, and cover are extruded.

9. The hinge of claim 1, further comprising a segmented door and at least a portion of the hinge is located on at least one segment of the segmented door.

10. The hinge of claim 9, wherein at least one of either the first gear and second gear is extruded as at least part of a segment of the segmented door.

11. The hinge of claim 1, wherein the first gear has fewer teeth than the second gear.

12. The hinge of claim 1, wherein the cover includes an elongated body that extends away from the first and second gears.

13. The hinge of claim 1, wherein the one or more first teeth are configured to engage the one or more second teeth after the first gear is introduced into the cover.

14. A hinge for movably attaching a pair of parts together along a longitudinal reference line, comprising:

a first gear on a first part of the pair of parts, the first gear having a first center of rotation aligned along a second reference line perpendicular to the longitudinal reference line and having a) a toothed area with one or more first teeth and b) an area with no teeth, the area with no teeth being disposed on both sides of the second reference line when the hinge is in a closed position;

a second gear on a second part of the pair of parts, the second gear having a second center of rotation and having one or more second teeth, wherein the longitudinal reference line extends through the first and second centers of rotation;

a cover configured to attach the first gear to the second gear, the cover comprising:

a first protrusion; and a second protrusion facing the first protrusion, the first protrusion fitting into a recess in the first gear and the second protrusion fitting into a recess in the second gear;

a first sliding surface on the first protrusion defining the first center of rotation; and a second sliding surface on the second protrusion defining the second center of rotation, wherein the first gear slides on the first sliding surface and the second gear slides on the second sliding surface when the hinge is operated, wherein the area with no teeth is shaped and sized to allow a portion of the first gear to slide past the second gear without engagement of the one or more first teeth and the one or more second teeth to introduce the first gear into the cover after a portion of the second gear is located in the cover.

15. The hinge of claim 14, wherein the hinge is located on a segmented door and at least one of either the first gear and second gear is extruded as part of a segment of the segmented door.

16. The hinge of claim 14, wherein the cover is extruded.

17. The hinge of claim 14, wherein the one or more first teeth are configured to engage the one or more second teeth after the first gear is introduced into the cover.

18. A hinge for movably attaching a pair of parts together along a longitudinal reference line, comprising:

a first gear on a first part of the pair of parts, the first gear having a first center of rotation aligned along a second reference line perpendicular to the longitudinal reference line and having a first portion with one or more first teeth and a second portion with no teeth, the second portion with no teeth being disposed on both sides of the second reference line when the hinge is in a closed position;

a second gear on a second part of the pair of parts, the second gear having a second center of rotation and having one or more second teeth, wherein the longitudinal reference line extends through the first and second centers of rotation;

a cover configured to attach the first gear to the second gear after the first and second gears have entered the cover through an opening defined by a first protrusion of the cover and a second protrusion of the cover, wherein the second portion with no teeth is shaped and sized to be introduced into the cover through the opening by sliding past the second gear while a portion of the second gear is located in the cover without engagement between the one or more first teeth and the one or more second teeth, and wherein the one or more first teeth are configured to engage the one or more second teeth after the second portion of the first gear is introduced into the cover;

a first sliding surface on the cover defining the first center of rotation; and a second sliding surface on the cover defining the second center of rotation, wherein the first gear slides on the first sliding surface and the second gear slides on the second sliding surface when the hinge is operated.

* * * * *